US005947407A

United States Patent [19]

Quigley

[11] Patent Number: 5,947,407

[45] Date of Patent: Sep. 7, 1999

[54] IN-LINE AUTOMATED ROLL STAND

[76] Inventor: John C. Quigley, 20 Lafayette St., Dracut, Mass. 01826

[21] Appl. No.: 09/128,200

[22] Filed: Aug. 3, 1998

[51] Int. Cl.[6] ..... B65H 19/00

[52] U.S. Cl. ..... 242/559.4; 242/559; 414/911

[58] Field of Search ..... 242/559, 559.4, 242/592, 597.1, 129.71, 557; 414/911

[56] References Cited

U.S. PATENT DOCUMENTS

| | | | |
|---|---|---|---|
| 2,681,187 | 6/1954 | Zettelmeyer | 242/597.1 |
| 4,005,793 | 2/1977 | Smith | 414/607 |
| 4,120,405 | 10/1978 | Jones et al. | 414/24.5 |
| 4,155,211 | 5/1979 | Lenk et al. | 242/473.4 |
| 4,267,985 | 5/1981 | Rogers | 242/521 |
| 4,375,936 | 3/1983 | Dechantsreiter | 414/626 |
| 4,693,433 | 9/1987 | Martin | 242/559.1 |
| 5,312,057 | 5/1994 | Graham | 242/470 |
| 5,437,528 | 8/1995 | Decker | 414/24.6 |
| 5,533,859 | 7/1996 | McHenry | 414/772 |
| 5,542,623 | 8/1996 | Garand et al. | 242/559.4 |
| 5,562,385 | 10/1996 | Tacchi et al. | 414/391 |
| 5,651,511 | 7/1997 | Crowley et al. | 242/420.3 |
| 5,673,869 | 10/1997 | Honegger | 242/528 |
| 5,688,098 | 11/1997 | Theno | 414/277 |
| 5,797,557 | 8/1998 | Wang et al. | 242/473.6 |
| 5,820,330 | 10/1998 | Focke et al. | 414/427 |
| 5,836,538 | 11/1998 | Lencoski et al. | 242/559.1 |

OTHER PUBLICATIONS

Perkin Catalog, C. Perkin Ltd.

PCS–6P Six Ply Paper Creel Stand advertisement, Paco Winders Mfg. Inc.

PCS–6P Six Play Paper Creel Stand with PCT–6P Six Ply Cascade Adhesive Tank advertisement, Paco Winders Mfg. Inc.

Tilt–Lock advertisement, Tilt Lock Inc. (A Division of TC/American Monorail, Inc.).

Yazoo Mills Catalog, Yazoo Mills Inc.

*Primary Examiner*—Donald P. Walsh

*Assistant Examiner*—Minh-Chau Pham

*Attorney, Agent, or Firm*—Brian L. Michaelis; Brown Rudnick Freed & Gesmer, PC

[57] ABSTRACT

A roll stand for holding rolls of material such as paper rolls which allows the rolls to be mounted and material fed out. The roll stand includes a roll supporting bar which is raised and lowered by a mechanical system such as an air piston. The roll supporting bar is lowered to allow a roll of material to be mounted, and then raised to allow the roll to turn freely. The roll stand includes a roll retainer, including a bar which swings down against the end of the roll, to keep the roll properly positioned on the roll supporting bar. The roll retainer swings up out of the way while a roll of material is mounted or removed. A rotating mechanism maintains the roll retainer in whatever position it is moved to. The roll stand may also be configured to support a plurality of rolls, each roll lifted into place on its own roll supporting bar. The roll supporting bars are positioned to hold all the rolls with a minimum of floor space.

9 Claims, 4 Drawing Sheets

IN-LINE AUTOMATED ROLL STAND

FIELD OF THE INVENTION

This invention relates to manufacturing equipment including roll stands, and more particularly, to an automatic powered roll stand for mounting and feeding out rolls of material, including paper for manufacturing paper tubes.

BACKGROUND

In the manufacturing industry, many different types of material are transported and used from rolls. In the factory, these rolls must be moved to proper locations and then mounted on various types of machinery for unwinding the material. For example, rolls of paper are fed out and processed to construct many products, including boxes and paper tubes. The rolls of paper can be quite large including sizes of 8" width paper on 70" diameter rolls and weigh anywhere up to 400–500 lbs.

These rolls have center holes and are typically mounted via the center hole on stands to be fed out. Many known stands allow rolls to be mounted on a roll bar which is simply a horizontally mounted bar for receiving the center hole of the roll. For the material to unwind without obstruction, the roll bar must be located far enough off the ground so a full roll does not contact any surface which would prevent its unwinding. Therefore, in common use, a worker must carry or transport or even roll the roll over to the stand and then physically lift the roll onto the roll bar. With rolls of varying sizes and weight, this is an incredibly strenuous operation and can easily result in back strains or other injuries. Often, the roll is so heavy that a mechanical assistance device such as a ramp, forklift or jack must be used to lift the roll far enough up and get it onto the stand roll bar. However, even with mechanical assistance, mounting the roll onto the roll bar is a slow, cumbersome and difficult operation. Production runs suffer as set up time increases.

Another problem is that many manufacturing techniques require many rolls of material to supply material simultaneously. For example, in paper tube construction, a plurality of strips of paper are glued and then pressed together in a circular overlapping roll, which produces a continuous paper tube which may then be cut to size. A number of strips of paper must be simultaneously drawn off of different rolls to be combined in the manufacturing process. Accordingly, roll stands are often manufactured to support a plurality of rolls. These multiple roll stands all suffer from the same problems as individual roll stands, including the difficulty of loading rolls onto the roll stands and the inability of roll stands to support rolls of various sizes and shapes.

In manufacturing paper tubes the rolls must be disposed in close proximity to one another. Multiple roll stands also suffer the disadvantage that the rolls are typically disposed parallel to one another. Consequently, multiple roll stands take up a lot of space on a manufacturing floor. Known in-line stands require manual lifting of the roll, and typically are configured so that rolls can not be placed in close proximity to one another.

SUMMARY

The present invention provides an in-line, automated roll stand facilitating easy and safe mounting of rolls of material, while maintaining the rolls in a proper position to feed out the material.

According to the invention the roll stand apparatus comprises a substantially vertical support component, with a roll supporting bar component coupled to the substantially vertical support component. The roll supporting bar component is configured to raise and lower along a portion of the substantially vertical support, as a function of a lifting component that is coupled to the roll supporting bar component and the substantially vertical support component. The roll support bar component is raised by a pneumatic implementation that automatically lifts a heavy roll without requiring significant effort by a worker.

The roll stand apparatus includes a roll retaining component, coupled to the substantially vertical support component above the roll supporting bar component. The roll retaining component includes a horizontal component extending out from the substantially vertical support component, and a swinging or vertical component extending outwardly from the horizontal component, and pivotally coupled to the horizontal component. The apparatus also includes a locking component coupled to the substantially vertical support component. When engaged, the locking component prevents vertical movement of the roll supporting bar component to substantially prevent any danger of rolls dropping unexpectedly.

An alternative embodiment of the present invention includes a plurality of substantially vertical support components disposed in-line with a common frame. Each station in the multiple roll stand according to the invention, includes a corresponding roll supporting bar component, lifting component and roll retaining component. The common frame couples each of the substantially vertical beam components in a row i.e. in-line as opposed to parallel. The roll supporting bar components are mounted on alternate sides of respective ones of a plurality of substantially vertical beam components, thereby allowing close spacing of the rolls of material for a compact design which saves floor space.

Features and advantages of the present invention include very easy operation for mounting rolls of material such as paper onto a roll stand, and lifting the rolls into proper position for feed out. Any manual effort and strength required to lift the rolls is effectively eliminated, thereby substantially preventing injury. Rolls are loaded and unloaded very quickly, with a minimum number of workers.

Other advantages include reliable safety features which prevent heavy rolls of material from coming off the stand, or dropping down unexpectedly. Safety lock mechanisms allow the apparatus to be unaffected by power or pressure losses.

Other advantages include a simple and economical design which can be constructed out of common components. There are no complicated mechanisms which are subject to break downs from heavy use.

With the automated, in-line, multiple roll stand according to the invention, rolls can be much more closely spaced than known implementations, allowing an increased number of production systems for a given amount of floor space.

BRIEF DESCRIPTION OF THE DRAWINGS

The foregoing and other features and advantages of the present invention will be more fully understood from the following detailed description of illustrative embodiments, taken in conjunction with the accompanying drawings in which.

DETAILED DESCRIPTION

Figure 1:
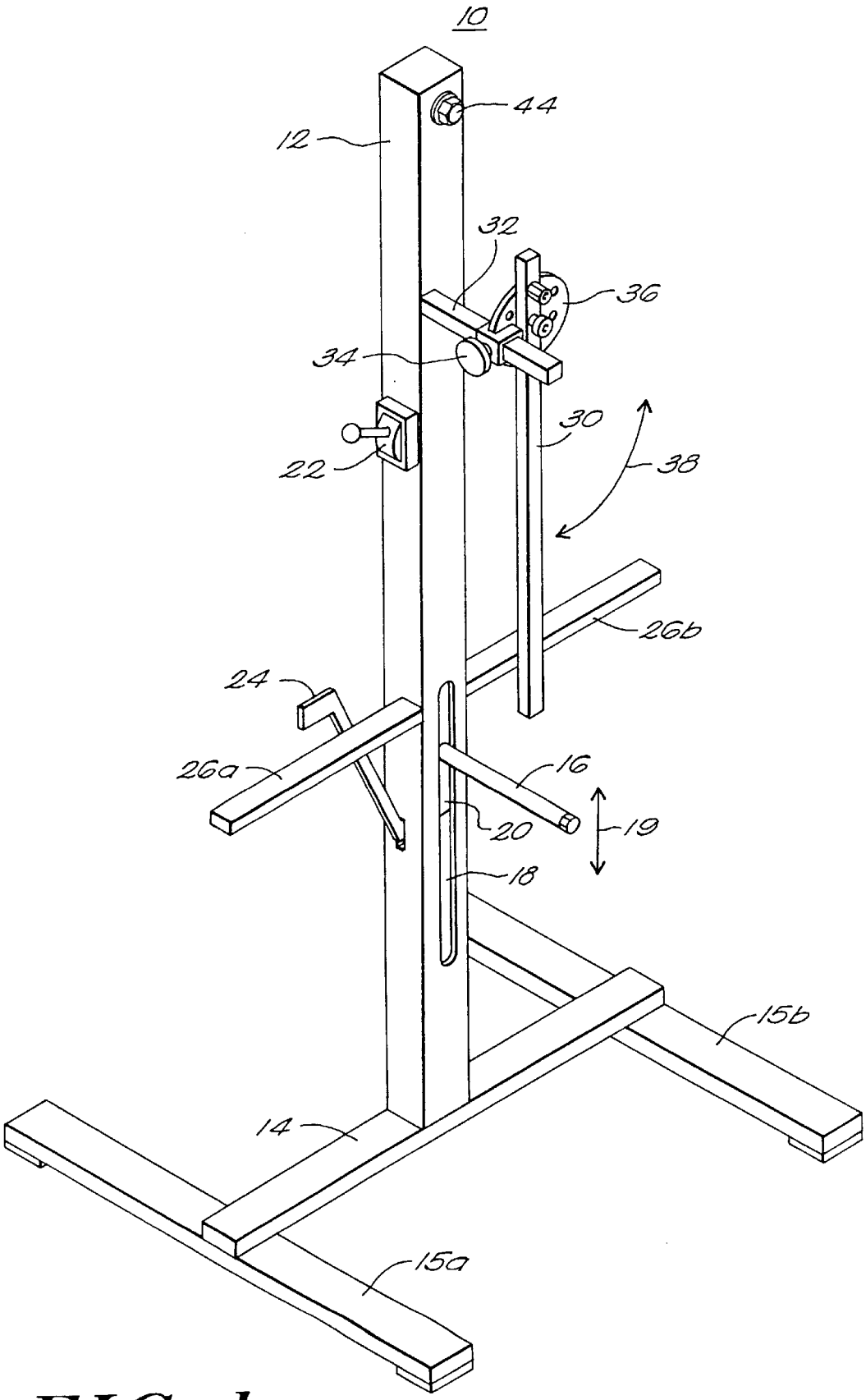
FIG. 1 is an overview of an illustrative embodiment of a single station roll stand according to the present invention.

An illustrative embodiment of a roll stand 10 according to the present invention is shown in FIG. 1. The roll stand 10 includes a substantially vertical support 12. The vertical support or beam 12 is supported upright by a cross brace 14 and side braces 15*a* and 15*b*. Alternatively, the vertical support 12 may be supported from the top or embedded into a floor, etc. The side braces 15*a* and 15*b* rest on the floor on shock absorbing pads, or alternatively may be mounted on rollers to facilitate moving the roll stand 10 to different locations.

The roll stand 10 includes a roll supporting bar 16. This roll supporting bar 16 is for supporting the roll of material (not shown) and allowing the material to be drawn off a mounted roll. The roll supporting bar 16 extends outwardly from the vertical support 12 through a bar opening 18. The bar opening 18 is generally a vertical oval opening, allowing vertical motion of the roll supporting bar 16 as shown by arrow 19. The roll supporting bar 16 in the illustrative embodiment is rigidly attached to a sliding insert sleeve 20 which fits inside of vertical support 12 as discussed hereinafter.

The vertical support 12 encloses a lifting mechanism for raising and lowering the roll supporting bar 16. A lifting control device 22 allows activation of the lifting mechanism to raise and lower the roll supporting bar 16. Details of the lifting control and lifting mechanism are discussed hereinafter as well.

A lifting lock 24 comprising a gravity actuated locking mechanism which engages the sliding insert sleeve 20 inside the vertical support 12 maintains the roll supporting bar 16 in a lifted position. This is to prevent the unexpected movement of the control bar 16 at any improper time. The roll stand 10 also may include side support bars 26*a* and 26*b* which maintain the roll in a proper plane as the roll material is fed out.

The illustrative embodiment of the present invention also includes a roll retainer 30 which prevents the roll from sliding off of the roll supporting bar 16 during use. The roll retainer 30 is attached to a horizontal bar 32 which in turn is attached to the vertical support 12. The position of the roll retainer 30 is adjustable along the horizontal bar 32 by a tightening mechanism 34, for example a screw tightening device, and will be discussed herein below. The roll retainer 30 also includes a rotational mechanism 36 which allows the roll retainer 30 to be rotated up and out of the way while a roll is mounted or unmounted. The roll retainer 30 generally rotates up as shown by arrow 38.

Figure 2:
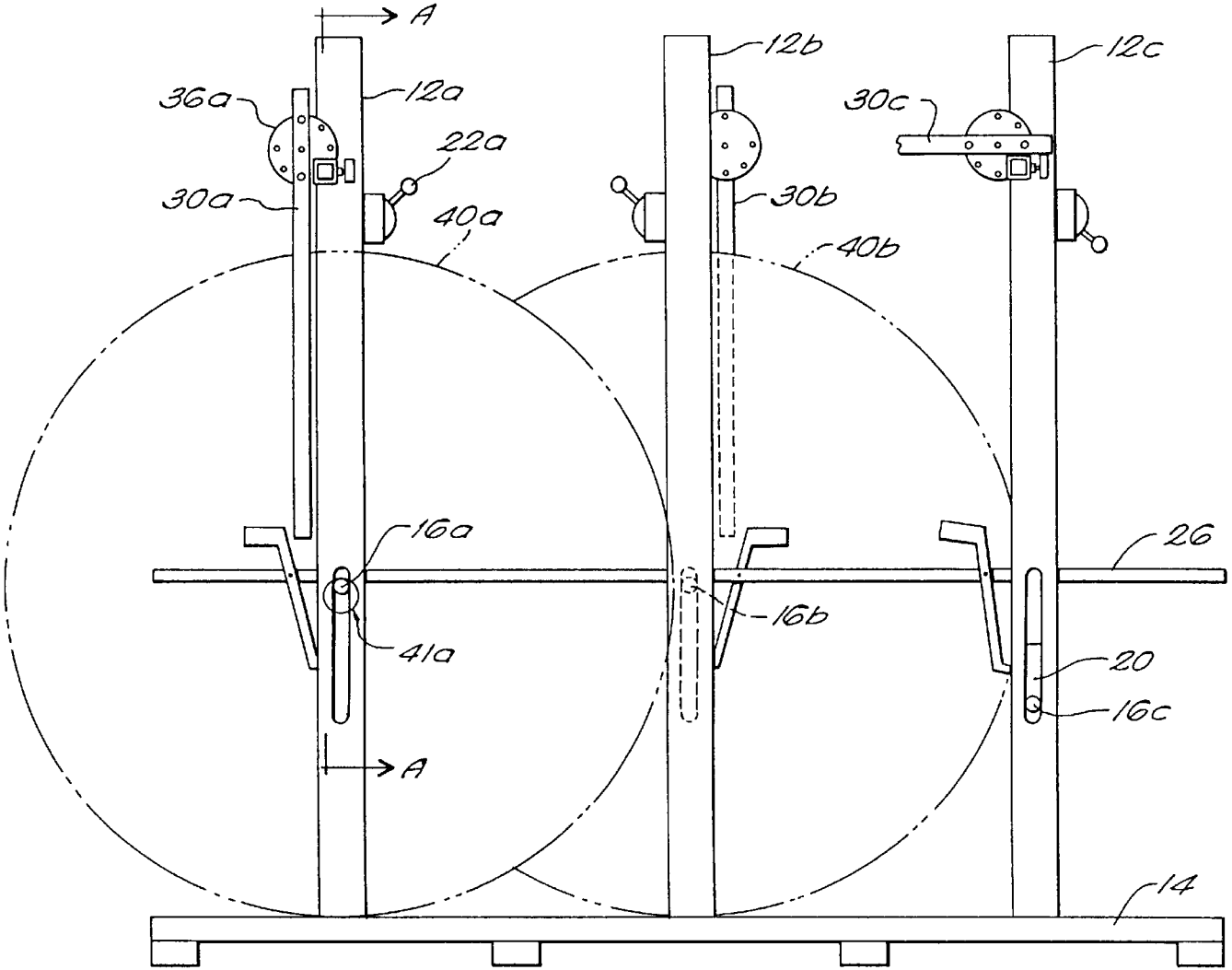
FIG. 2 illustrates an embodiment of the present invention configured to hold multiple rolls of material.

An alternate embodiment of the present invention is illustrated in FIG. 2. Here, the roll stand holds several rolls of material (40*a* and 40*b*, shown in phantom). As shown in FIG. 2, a roll of material 40*a* is mounted on the roll supporting bar 16*a* through the center hole 41*a* of the material 40*a*. With the roll supporting bar 16 automatically actuated to the lifted position, the roll of material 40*a* is lifted up off the floor or surface thereby allowing free rotation around the center point 41A.

In the embodiment shown in FIG. 2, the roll-supporting bars 16*a–c* are positioned on alternating sides of the vertical supports 12*a–c*. Also, the roll retainers 30*a–c* are mounted on alternating sides of the vertical supports 12*a–c*. This allows the rolls of material (for example rolls 40*a* and 40*b* as shown) to overlap and thereby save floor space as illustrated in FIG. 2. The roll supporting bar 16*c* is in the lowered position for allowing the mounting of a roll 40*c* (not shown) which when raised, will also overlap roll 40*b*. This alternating design allows efficient use of space as well as positioning the rolls 40 in close proximity which is an advantage for feeding the material off of the rolls. For example, in unwinding rolls of paper, the close positioning of the rolls 40 prevents unnecessary waste between the rolls for requiring different lengths of lead paper to reach nearby machinery.

Figure 3:
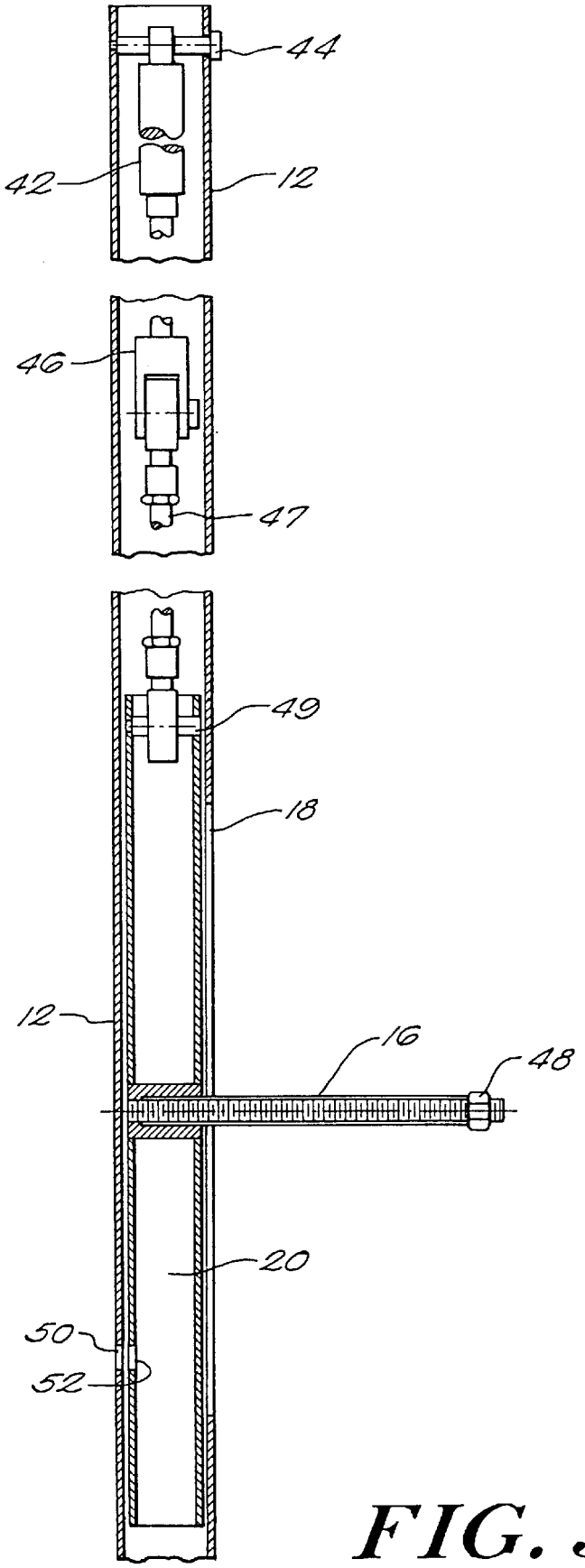
FIG. 3 is a cross-sectional view of a portion of the roll stand including a roll support bar and lifting mechanism according to the present invention.

A powering mechanism having lift capacity that is a function of the weight of the rolls to be lifted is used in the present invention to raise and lower the rolls of material 40. In the illustrative embodiment, an inner air piston 42 illustrated in FIG. 3 provides the powering or lifting component, that is enclosed inside the vertical support 12. The air piston 42 is securely held at the top of the vertical support 12 by an anchoring system such as a bolt 44. The inner air piston 42 in this illustrative embodiment is a 2½ BIMBA cylinder including an exhaust muffler (not shown). An air fitting is connected to the lifting control 22. The air valve is an S.M.C. 3-way manual lever air valve which controls delivery of air to the cylinder. Pressurized air is provided through a standard hose connected to a standard air pressure source for industrial use, such as a compressor. In this illustrative embodiment inlet and outlet cylinder orifices are flow restricted, by selecting an appropriate dimension that limits the speed at which the cylinder raises and lowers the roll supporting bar 16. The cylinder orifices are illustratively limited to one sixteenth to one eighth inch An air pressure of 100 PSI is sufficient to raise and lower rolls weighing up to 400–500 pounds. The inner piston 42 is connected through a clevis block 46 which then connects to a threaded rod 47 down to the sliding insert 20. The threaded rod 47 is connected to the sliding insert 20 by a shoulder bolt 49. The sliding insert 20 has the roll supporting bar 16 attached thereto.

Alternatively, other sources of lifting power may be used, including a hydraulic cylinder, electric motor with thread drive or gear, heavy duty solenoids, a lever action to assist users in applying force to lift the roll, pulley system, etc. The lifting mechanism may also be mounted below the roll supporting bar 16, in order to push the roll up from below.

The locking mechanism 24 works via gravity to lock the sliding insert 20 to preclude inadvertent lowering by engaging a protrusion through a hole 50 in the vertical support 12 which lines up with a hole 52 in the sliding insert 20. A single hole in the sliding insert 20 may be used for the top position, or alternatively, a number of holes may be positioned in the sliding insert 20 to allow different height adjustments. Other locking mechanisms may be used, including a frictional braking device, solenoid engaging bolt, etc.

Figure 4:
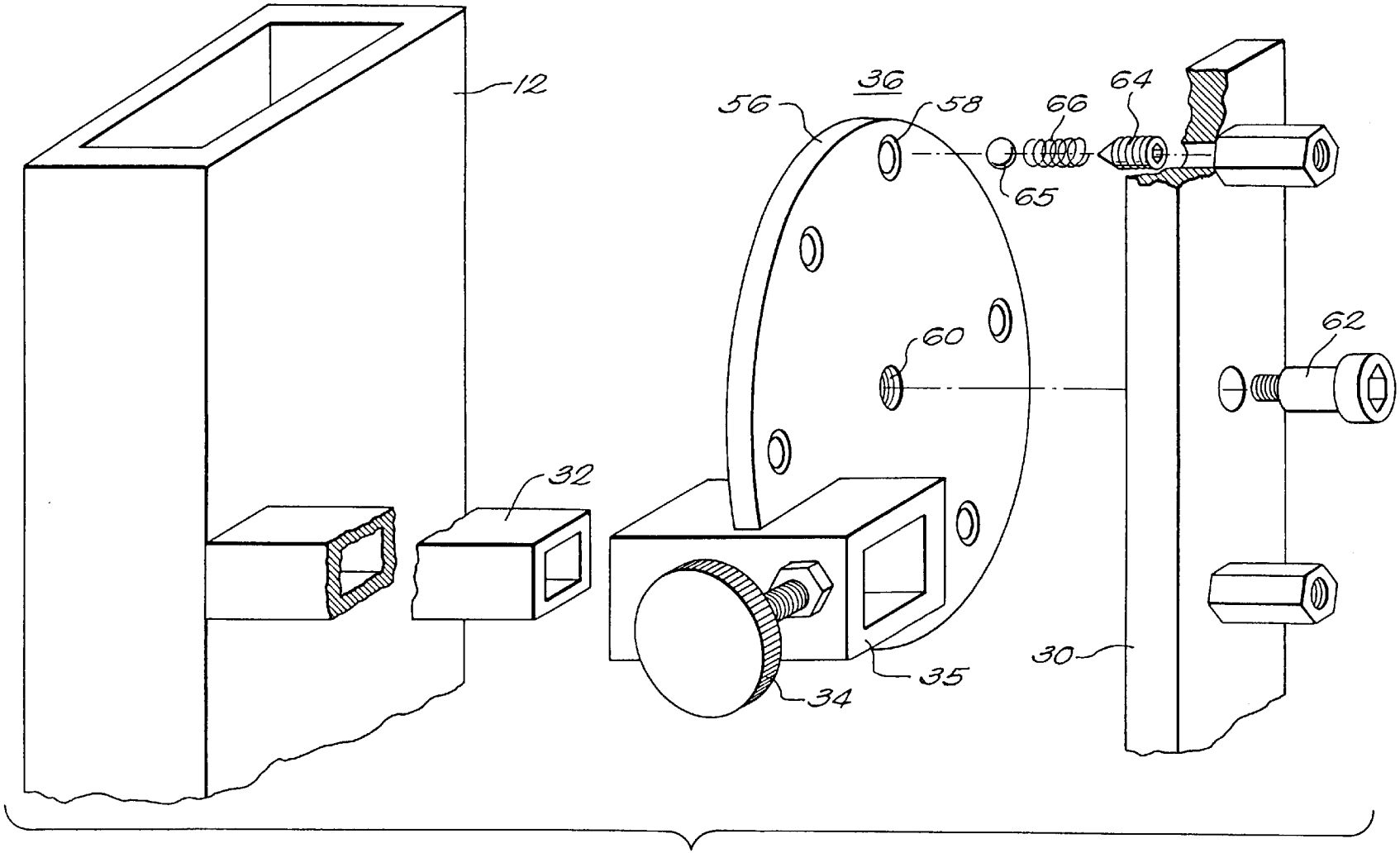
FIG. 4 is an exploded view of a portion of a roll retaining component according to the present invention.

Turning now to FIG. 4, details of the roll retainer 30 and roll retainer ratchet or ball/detent mechanism 36 will now be discussed. The horizontal bar 32 is attached to vertical support 12 and extends out horizontally. A surrounding sleeve 35 with tightening bolt 34 is slid onto the horizontal bar 32 thereby allowing the roll retainer 30 to be adjusted for varying lengths or sizes of rolls. Once in position, the tightening mechanism 34 is tightened down against horizontal bar 32 to prevent motion. Alternatively, the horizontal bar 32 may include holes spaced along its length, with a spring engaging bolt to engage a hole. These holes may also be spaced at appropriate positions to match standard roll sizes (not shown).

The roll retainer 30 can be held in several positions due to roll retainer ratchet mechanism 36. In the illustrative embodiment, a ¾ cylindrical disc 56 is attached to the surrounding sleeve 35. The cylindrical disc 56 includes a threaded center hole 60 for mounting the roll retainer 30 thereto, such as via a bolt 62. The bolt is configured to allow the roll retainer 30 to pivot along the axis of the plane as described by the cylindrical disc 56.

The ratchet or ball/detent mechanism 36 comprises holes or indentations 58 in the cylindrical disc 56, engaged by a ball 65 biased by a spring 66. A pin 64 is attached to the roll retainer 30 to retain the ball 65 and spring 66 within a void in the roll retainer 30. In the illustrative embodiment, two ratchet mechanisms are included, thereby including matching holes 58 at 180° around the cylindrical disc 56. As the roll retainer 30 is rotated, the engaging ball 64 is engaged in the various holes 58 in cylindrical disc 56, to hold the roll retainer 30 in that position. Therefore, the roll retainer 30 can easily be raised to a horizontal position out of the way of the roll 40 and will remain in that position until lowered again by a worker. Although described as a system allowing a user to manually raise and lower the roll retainer 30, an automatic system may be used employing a powered system to raise and lower retainer bar 30, such as an air piston, or electric motor.

The illustrative embodiment of the present invention is easy to use. A worker brings a roll of material 40 over to the roll-stand 10 and raises the roll retainer up out of the way. If the roll supporting bar 16 needs to be lowered, the worker releases the lifting lock 24 which allows the roll-supporting bar 16 to drop down to the lower position. The roll 40 is mounted on the roll supporting bar 16 while the roll 40 is still supported by the floor or trolley. Once the roll 40 is in position, the worker activates the lifting control mechanism 22 thereby raising the roll-supporting bar 16 and lifting the roll 40 up. The worker then lowers the roll-retainer 30 to be adjacent to the roll 40, thereby ensuring that the roll 40 can not work its way off the end of roll-supporting bar 16. The worker then feeds the end of the material on roll 40*a* into the appropriate transporting mechanisms and machinery.

To remove a roll from the present invention, the above steps are reversed. The worker rotates the roll retainer 30 out of the way of the roll, as shown by the roll retainer 30*c* in FIG. 2. The roll-retainer 30 will remain in whatever position it is set in due to the rotational mechanism 36 as will be discussed below. The worker then activates the lifting controller 22 to lower the roll down and/or releases the lifting lock 24 to allow the roll to descend until it is supported by the floor. In the illustrative embodiment, a braking force or mechanism allows the roll supporting bar 16 to lower slowly, thereby preventing an abrupt drop.

The present invention is implemented using common materials used in industry. Most elements are constructed out of industrial strength welded steel to accommodate heavy loads and stress from constant use. As shown in FIG. 3, the vertical support 12 is preferably constructed out of box or tubular steel with the sliding insert sleeve 20 fitting slideably inside. The roll supporting bar 16 is connected to inner sleeve 20 using a threaded rod and nut 48 extending therethrough to provide maximal support.

The illustrative embodiment of the present invention is approximately 7 feet tall. The roll supporting bar 16 has a lowered position height of approximately 15 inches and an upper position height of approximately 31 inches. The roll retainer 30 is mounted on the vertical support 12 at a height of approximately 6 ft. to clear rolls up to 60 inches in diameter. The position of the roll retainer 30 can be extended out to a distance of 10 inches along the horizontal bar 32. In multi-roll units, as illustrated in FIG. 2, the vertical supports 12*a–c* are positioned 62 inches center to center to accommodate rolls up to 60 inches in diameter. It will be appreciated that such illustrative dimensions can be changed as a function of the application.

Although the roll stand illustrated in FIG. 2 includes roll supporting bars for three rolls, it should be appreciated that any number of structures with roll supporting bars may be used to support any number of rolls. Also, a different roll positioning arrangement may be used, including taller vertical supports 12, with roll supporting bars 16 which raise to different heights, which allows alternating paper rolls to be raised to one height, and then the remaining rolls raised to a lower height below the first rolls.

Although the invention is shown and described with respect to an illustrative embodiment thereof, various other changes, omissions and additions in the form and detail thereof may be made therein without departing from the spirit and scope of the invention.

What is claimed is:

1. A roll stand for holding a roll of material, said material to be loaded on and fed out from said stand, said roll stand comprising:

a substantially vertical support component;

a roll supporting bar component, coupled to said substantially vertical support component; and a lifting component at least a portion of which is enclosed by said substantially vertical support component and coupled to said roll supporting bar component to raise and lower said roll supporting component along a portion of said substantially vertical support component.

2. The apparatus of claim 1 further including:

a roll retaining component, coupled to said substantially vertical support component above said roll supporting bar component, said roll retaining component including a horizontal component extending out from said substantially vertical support component, and a vertical component extending down from said horizontal component, said vertical component being pivotally coupled to said horizontal component.

3. The apparatus of claim 2 wherein said vertical component is slidingly coupled to said horizontal component whereby said vertical component may be moved to any position along said horizontal component.

4. The apparatus of claim 3 including at least one ratchet mechanism allowing said vertical component to pivot up and remain in a selected position.

5. The apparatus of claim 2 comprising:

a plurality of substantially vertical support components, each one including a corresponding roll supporting bar component, lifting component and roll retaining component; and a common connection bar component coupled to each of said substantially vertical support components in a row;

wherein said roll supporting bar components are alternately mounted in-line on left and right sides of said substantially vertical support components in a row.

6. The apparatus of claim 1 further including a locking component coupled to said substantially vertical support component, wherein when engaged, said locking component preventing movement of said roll supporting bar component.

7. The apparatus of claim 1 wherein said substantially vertical support component encloses substantially all of said lifting component and said roll supporting bar extends outwardly from said substantially vertical support component.

8. The apparatus of claim 1 wherein said substantially vertical support component includes an opening, and said roll supporting bar component extends outwardly through said opening.

9. The apparatus of claim 1 further including a sliding member, said roll supporting bar component being fixedly attached to said sliding member, said sliding member being coupled to said lifting component to raise and lower said roll supporting bar component.

* * * * *